US008353236B2

(12) United States Patent
De Marco et al.

(10) Patent No.: US 8,353,236 B2
(45) Date of Patent: Jan. 15, 2013

(54) PERFORATING EQUIPMENT FOR CONTINUOUS FORMS IN MOVEMENT

(75) Inventors: Giuliano De Marco, Ivrea (IT); Armando Aprato, Ivrea (IT); Francesco Terrusi, Ivrea (IT); Francesco Modica, Ivrea (IT)

(73) Assignee: TECNAU, S.r.l., Ivrea (IT)

( * ) Notice: Subject to any disclaimer, the term of this patent is extended or adjusted under 35 U.S.C. 154(b) by 445 days.

(21) Appl. No.: 12/702,909

(22) Filed: Feb. 9, 2010

(65) Prior Publication Data

US 2010/0199822 A1 Aug. 12, 2010

(30) Foreign Application Priority Data

Feb. 11, 2009 (IT) ..... TO2009A0101

(51) Int. Cl.
*B31B 1/14* (2006.01)

(52) U.S. Cl. ..... 83/887; 83/492; 83/508.1; 83/678

(58) Field of Classification Search ..... 83/887, 83/351, 678, 659, 614, 591, 508.1, 492, 660, 83/872, 304, 305, 672, 695, 862
See application file for complete search history.

(56) References Cited

U.S. PATENT DOCUMENTS

| | | | | |
|---|---|---|---|---|
| 2,836,018 | A * | 5/1958 | Key | 451/58 |
| 3,686,988 | A * | 8/1972 | Ross | 83/300 |
| 4,058,041 | A * | 11/1977 | Ito | 83/305 |
| 4,063,692 | A * | 12/1977 | Buggy | 242/530.3 |
| 5,393,294 | A * | 2/1995 | Jobst | 493/342 |
| 5,533,956 | A * | 7/1996 | Komarek et al. | 493/355 |
| 5,572,433 | A * | 11/1996 | Falconer et al. | 700/127 |
| 5,799,898 | A * | 9/1998 | Sumida et al. | 242/530.1 |
| 6,050,927 | A * | 4/2000 | Harrod | 493/22 |
| 6,117,381 | A * | 9/2000 | Cummings | 264/269 |
| 6,289,777 | B1 * | 9/2001 | Hartmann et al. | 83/30 |
| 6,394,330 | B1 * | 5/2002 | Jackson | 225/2 |
| 6,460,441 | B1 * | 10/2002 | Harrod | 83/304 |
| 6,722,243 | B2 * | 4/2004 | Adami | 83/508.1 |
| 6,793,169 | B2 * | 9/2004 | Fujiwara et al. | 242/530.1 |
| 7,484,445 | B2 * | 2/2009 | De Marco et al. | 83/342 |
| 2004/0149378 | A1 * | 8/2004 | Cummings et al. | 156/250 |
| 2004/0177737 | A1 * | 9/2004 | Adami | 83/508.1 |
| 2005/0029388 | A1 * | 2/2005 | Fujiwara et al. | 242/523.1 |
| 2010/0095818 | A1 * | 4/2010 | Sandahl et al. | 83/155 |
| 2011/0277613 | A1 * | 11/2011 | Rimai et al. | 83/865 |

FOREIGN PATENT DOCUMENTS

| | | |
|---|---|---|
| DE | 526836 | 6/1931 |
| EP | 0783940 | 7/1997 |
| EP | 1484145 | 12/2004 |

* cited by examiner

*Primary Examiner* — Sean Michalski
(74) *Attorney, Agent, or Firm* — Banner & Witcoff

(57) ABSTRACT

A perforating equipment (111) for continuous forms in movement comprises tree transversal perforating device (54, 56, 57) for executing transversal perforations on continuous forms (58) to be divided in three longitudinal sections and continuous forms to be divided in two longitudinal sections. Each perforating device includes a contrast member (61, 62, 79), a blade support mounting a blade (116*a*, 117*a*, 118*a*) for the three section form and a blade (116*b*, 117*b*, 118*b*) for the two section form, a blade servomechanism (73, 74, 85) and an activation group (104, 106, 107). The blade servomechanism rotates the blade support for a condition of interference of a blade in the position of perforation; and the activation group causes the contrast member to contrast a corresponding blade for the perforations of the forms to be divided into three sections, or the forms to be divided into two longitudinal sections.

11 Claims, 9 Drawing Sheets

PERFORATING EQUIPMENT FOR CONTINUOUS FORMS IN MOVEMENT

FIELD OF THE INVENTION

The present invention relates to a perforating equipment for continuous forms in movement.

More specifically, the invention relates to a perforating equipment for continuous forms in movement comprising a first transversal perforating device and a second transversal perforating device according to the introductory portions of the main claim.

BACKGROUND OF THE INVENTION

Perforating equipments are used for executing transversal perforations in systems for the automatic processing of documents derived from continuous paper forms.

Such systems use high speed printers, in which the cost of print for the customers depends on the number and not on the width of the printed lines. It has brought to provide equipments for processing documents derived from continuous forms having a width double with respect to the width of the component sheets: the form is cut longitudinally into two sections, and thereafter trimmed and transversely cut at the requested dimensions, according to the "two-up" technique.

An equipment for the perforation of two longitudinal sections of a continuous form in movement has been described in the Italian patent application TO 2003A000418, filed on Jun. 4, 2003 and assigned to Tecnau S.r.I. The equipment processes forms up to 520 mm (20½") and uses two transversal perforating devices arranged one behind the other along the direction of movement. The perforating devices include blades inclined with respect to the direction of movement, contrast rollers synchronous with the movement of the forms and servomechanisms of control for the rotation of the blades and the perforation in synchronism with the velocity of the forms. The equipment operates at high velocity with large possibility of positioning of the perforations in the obtainable documents.

For further saving of costs, printers have been proposed adapted to print documents on continuous forms of over 590 mm, to be longitudinally cut into three longitudinal sections, according to a "three up" technique. However, the transversal perforating devices currently in commerce are not adapted to operate in systems which use printers for continuous forms to be cut into more than two longitudinal sections at the output velocities allowed by the current technologies.

SUMMARY OF THE INVENTION

An object of the present invention is to accomplish a perforating device for continuous forms in movement to be separated into more than two longitudinal sections, of high productivity and which executes, with limited costs, transversal perforations of different typologies.

According to this object, the perforating equipment for continuous forms comprises a first transversal perforating device and a second transversal perforating device, for executing transversal perforations on requested positions of the form. The perforating equipment is provided for perforating continuous forms to be divided in three longitudinal sections and comprises a third transversal perforating device similar to the first perforating device. Each transversal perforating device includes: a contrast member with a contrast surface; a blade support provided for rotation and mounting at least a perforating blade for executing transversal perforations; a blade servomechanism controlling the rotation of the blade support for a condition of interference of the blades in the respective requested position of the form; and an activation group. The blade supports of the first perforating device and the second perforating device mount two blades of which a blade for two section forms is associated to the perforation of continuous forms to be divided in two longitudinal sections and a blade for three section forms is associated to the perforation of continuous forms to be divided in three longitudinal sections, while the activation group is functional to the positioning of the contrast surface against the blade for three section forms for perforating the forms to be divided in three sections, or functional to the positioning of the contrast surface against the blade for two section forms for perforating the forms to be divided in two longitudinal sections.

With this structure, the perforations of the continuous form in three longitudinal sections or in two longitudinal section are easily accomplished before the cutting and trimming of the form for the separation and the stacking of the sheets which define the single documents.

Another object of the present invention is to accomplish a perforating device for continuous forms in movement which has the possibility of executing, with limited costs, transversal perforations at high velocity, also in the case of perforations either close or spaced away each the other.

According to this other object, the perforating device comprises a contrast member, an indented perforating blade mounted on a blade support provided for rotation in condition of interference with the form against a contrast surface of the contrast member for the execution of transversal perforations, and a blade servomechanism, servoized to indications of position of the form, for rotating the support blade with blade in synchronism with the form and perforation in a requested position. A circuit control member for the blade servomechanism responds to information of a following perforation in association with the execution of a current perforation and in due time for the following perforation; and in which the control member operates on the servomechanism for maintaining, when necessary, the perforating blade in movement after the current perforation at a given basic velocity, in preparation of the following perforation.

According to a further characteristic, the perforating equipment comprises a perforating device including a contrast member, more indented perforating blades mounted on a blade support for the execution of transversal perforations, and a blade servomechanism, servoized to indications of position of the form, for rotating the support blade in synchronism with the form and perforation in a requested position The perforating device further comprises an activation group for positioning the contrast surface of the contrast member on an operational area of a blade in transit between a condition of perforation, of engagement of the blade and an inoperative condition of disengagement of the blade. A circuit control member drives the blade servomechanism and the activation group for the condition of interference of one of the indented blades with the contrast surface so as to execute a typology of perforation associated with said blade and for the inoperative condition of the other blade or the other blades.

According to a given embodiment of the invention, the perforating device comprises a contrast roller, substantially tangent to the movement surface of the continuous form and synchronous with the feeding, at least a perforating blade mounted on a blade support provided for rotation in condition of interference with the form against the roller for the execution of transversal perforations and a servomechanism servoized to indications of position of the form, for rotating the support blade with a selected blade in synchronism with the form and perforation in a requested position. A shifting mechanism is actuatable for modifying the distance between the contrast rollers and the blade support between a condition of perforation, of engagement of a selected blade and an inoperative condition of disengagement of the blade or the blades. In particular, the shifting mechanism includes a pair of eccentric cams, a pair of cam follower rollers, coaxial with the contrast roller and in engagement with the eccentric cams and a motor, actuatable for a cycle of rotation of the eccentric cams between a position of minimum lifting for the inoperative condition of the contrast roller and a position of maximum lifting for the condition of perforation of the contrast roller. The contrast roller is arranged above the eccentric cams and comprises a shaft supported by a pair of bearings and on which the pair of cam follower rollers are mounted, and in which the contrast roller is arranged above the eccentric cams while said bearings have possibility of vertical sliding along fixed guides.

The characteristics of the invention will become clear from the following description given purely by way of non-limiting example, with reference to the appended drawings in which:

DESCRIPTION OF THE PREFERRED EMBODIMENTS

Figure 1:
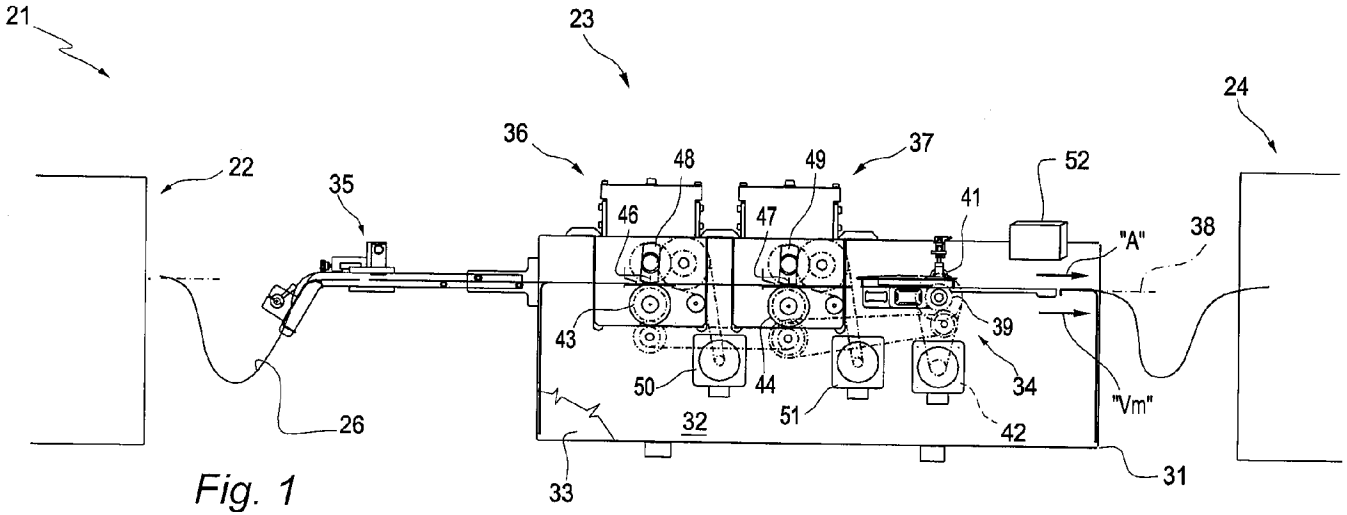
FIG. 1 represents the scheme of a system for the automatic processing of documents, comprising a perforating equipment for continuous forms in movement of known type.

With reference to the FIG. 1, is represented with 21 a system for the automatic processing of documents, of known type, comprising a high speed printer 22, a perforating equipment 23 according to the invention and a finishing equipment 24.

Figure 2:
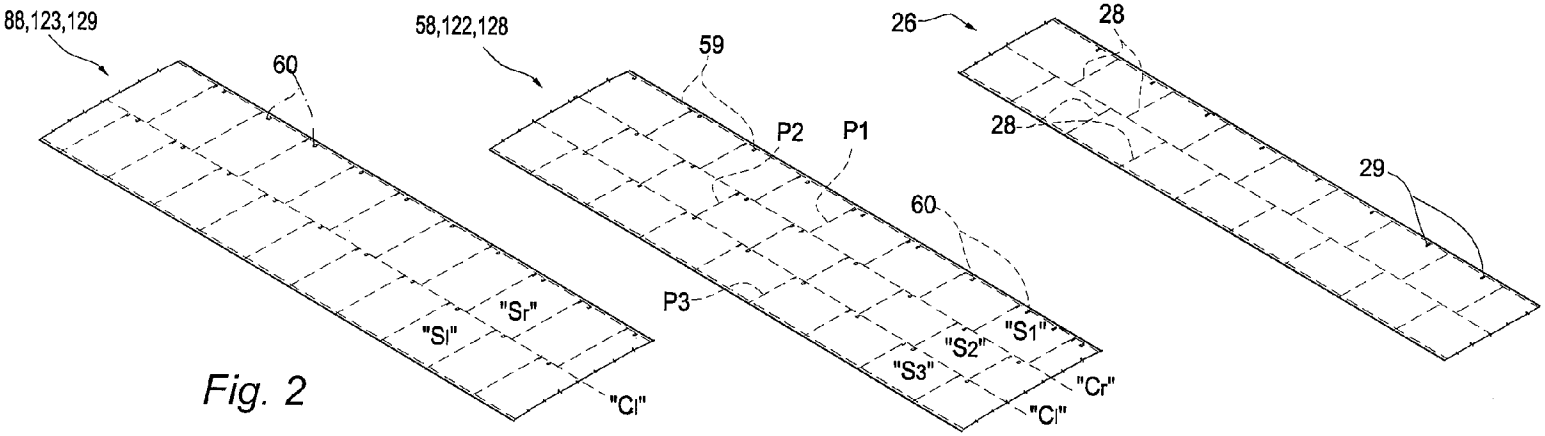
FIG. 2 shows schematically examples of continuous forms processed by the system of FIG. 1.

The system 21 uses a continuous form 26 (see FIG. 2) of paper material and in which the perforating equipment 23 executes transversal perforations 28 for making easier the tear separation of sheets or their portions. The printer 22 is of known type, for instance of laser type, and prints on the forms the information regarding the sheets which constitute the documents. Moreover, on an edge of the form and in association with the same sheets, it prints codes 29 with information regarding the positioning of the cuttings and the perforations. The finishing equipment 24 includes cutting mechanisms and sequencers for forming stacks of sheets separated from the form 26.

The equipment 23 can also be used in association with other finishing apparatuses and off-line from the printer, by receiving the continuous form from a, not shown, unwinding device. In the case of on-line use, suitably controlled loop forming devices for the form 26 can be provided between the various equipments and velocity regulators for a correct moving of the form.

The perforating equipment 23 is of the type described in the above cited patent application TO 2003A000418, whose content is herein included as references. In synthesis, the equipment 23 includes a frame 31 with two sides 32 and 33 and support elements for the form 26 (not shown). A feeding mechanism 34 provides to the movement of the form at a constant velocity Vm and a sensing device 35 reads the codes 29 regarding the position of the perforations on the sheets of the document. The perforations 28 are executed by a first perforating device 36 and a second perforating device 37, both provided with rotating blade and contrast member.

The support elements of the equipment 23 support and guide the entering continuous form along a movement surface 38, substantially horizontal, while the feeding mechanism 34 is adjacent to the output area. In particular, the feeding mechanism includes a motor roller 39 and a pinch roller 41, in central position, actuated by a feeding motor 42 associated to a position encoder. The perforating device 36, 37 comprises a contrast roller 43, 44, as contrast member, and an indented perforating blade 46, 47. The rollers 43 and 44 are rotatable in condition of tangency with the movement surface 38 and are actuated by the feeding motor 42. The blade 46, 47 is carried by a blade support 48, 49 rotatable parallel to the roller 43 and 44 and is actuated by a servomechanism 50, 51, on control of an electronic processing unit 52.

In the use, the contrast rollers 43 and 44 rotate with peripheral velocity equal to the velocity of movement of the continuous form 26. The blade supports 48, 49 are provided for rotation between an inoperative condition, in which the blade 46, 47 is disengaged from the respective roller 43 or 44, and a condition of perforation in which it is in interference with the roller 43 or 44 for the execution of the perforations 28. The servomechanisms 50 and 51 respond to the information of the sensing device 35 and to information from the position encoder of the form for causing the blade 46, 47 to interfere with the roller 43, 44, in the perforating positions, with a peripheral velocity of the blade substantially equal to the moving velocity of the form 26.

Figure 3:
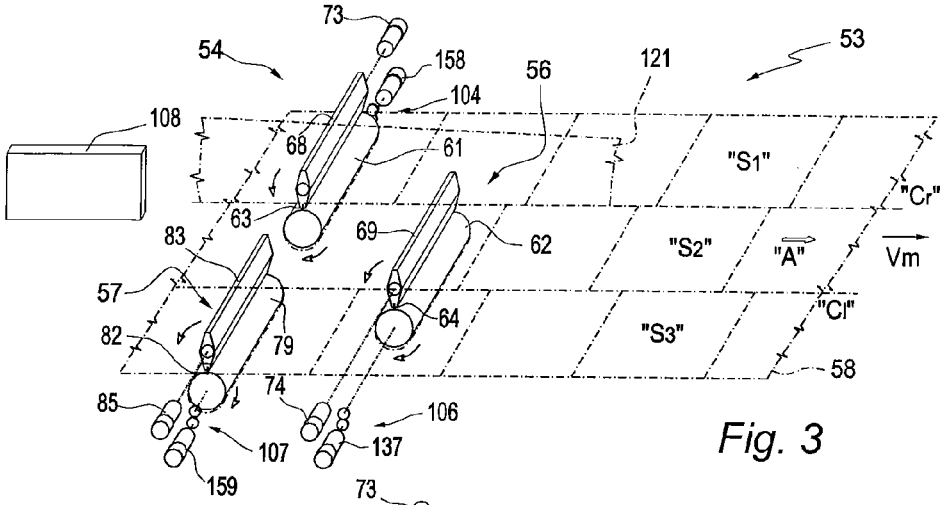
FIG. 3 represents a scheme of principle for an example of execution of the perforating equipment according to the invention.

A perforating equipment according to a first embodiment of the invention has been represented with 53 in FIG. 3 as scheme of principle. Its general structure is similar to the one of the known equipment 23 of FIG. 1 and has an identical feeding mechanism for the continuous form, not shown in the drawings. Specifically, the equipment 53 includes a first transversal perforating device 54 and a second transversal perforating device 56 arranged one behind the other along the direction of movement of the form.

According to the invention, the equipment 53 includes a third transversal perforating device 57 and handles a continuous form 58 (see FIG. 2), to be separated into three longitudinal sections "S1", "S2" and "S3" along longitudinal cuts "Cr" and "Cl". The forms 58 have start sheet codes or marker 59 and perforation codes 60, similar to the codes 29, with information regarding the typology of the perforation and the position thereof with respect to the marker 59. The codes 60 can be either of a liner bar code type or of a two-dimensional type. Further, the equipment 53 includes a sensing device for the markers 59 and the codes 60, not shown in the figures, and a power and control system for the various electro-mechanic components, also similar to the one of the known equipment 23 of FIG. 1. The transversal perforating devices 54, 56 and 57 execute transversal perforations P1, P2, P3 in the sections "S1", "S2" and "S3". Thereafter, a cutting and stacking equipment (not shown) provides to separate the sections "S1", "S2" and "S3" along the cuts "Cr" and "Cl" and to stack the single sheets forming the documents.

The transversal perforating device 54, 56 includes a contrast member constituted by a roller 61, 62 and an indented perforating blade 63, 64. The rollers 61 and 62, in steel, are rotatable, around the respective axes, with the lateral surfaces tangent to the movement surface 38 of the form 58 and in synchronism with the feeding velocity Vm of the form. The blade 63, 64 is carried by a respective blade support 68, 69 formed by a shaped elongated bar rotatable with an axis parallel to the axis of the roller 61, 62 and actuated by a servomechanism 73, 74. In particular, the blade 63, 64 is lodged in a seat with helicoidal walls of the blade support 68, 69 and is fixed, by means of screws, with possibility of easy replacing and regulation, as described in the cited patent application TO 2003A000418.

Figure 5:
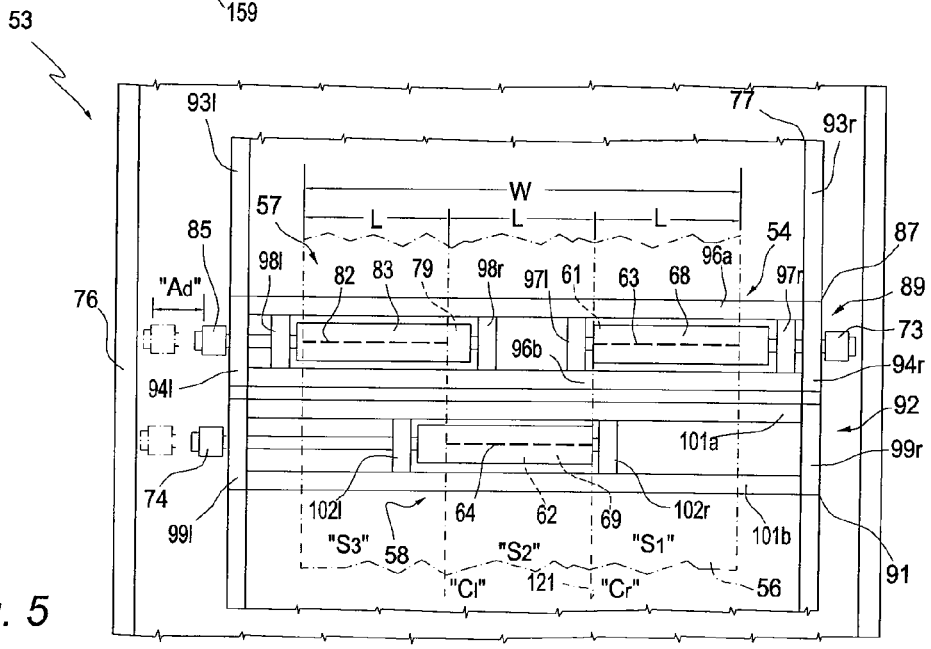
FIG. 5 shows a plan view of some components of a perforating equipment according to the invention.

According to the invention, the equipment 53 (FIGS. 3 and 5) comprises a frame 76 on which is mounted a sub-frame 77 which supports the perforating devices 54, 56 and 57. In detail, the third perforating device 57 is similar to the first device 54 and includes a respective contrast member constituted by a roller 79 and an indented perforating blade 82 carried by a blade support 83. A servomechanism 85, similar to the servomechanism 73, controls the rotation of the support 83 for the condition of interference of the blade 82 against the roller 79 with perforation in the requested position of the form 58. The first perforating device 54 and the third device 57 are provided for executing the lateral perforations of the form 58 to be separated into three sections, while the second device 56 is provided for executing the central perforations.

In the use, the contrast members constituted by the rollers 61, 62 and 79 rotate at a constant peripheral velocity equal to the feeding velocity Vm of the form 58. The blade supports 68, 69, 83 are provided for rotation around their axes to be commutated between an inoperative condition, in which the blade 63 or 64 is disengaged from the respective roller 61 or 62, and a condition of perforation, in which a blade interferes with the roller 61 or 62 for the execution of the perforations 28 on the form. For the rotation of the supports 68, 69 and 83, the servomechanisms 73, 74 and 85 are servoized to the codes 60 of the continuous form 58 and the information from the position encoder of the form so as to cause the blade 63, 64, 82 to interfere with the roller 61, 62, 79 in the positions of perforation, with a peripheral velocity of the cutting edge substantially equal to the velocity "Vm" of the form.

The blades 63, 64 and 82 extend for the length of the perforations P1, P2, P3. The blade supports extend for less than the maximum width of the forms 58, for reducing the masses to be moved during the perforations, but more than the length of the same perforations. In view of the fact that the rollers 61 and 62 and 79 rotate at uniform velocity, the length of the rollers can be much more bigger than the length of the perforations P1, P2, P3.

As described in the cited patent application TO 2003A000418, the axes of the contrast roller 61, 62, 79 and the support blade 68, 69, 83 are substantially parallel each the other and are inclined of a small angle with respect to a directrix perpendicular to the direction of movement "A" of the form 58. The indented blade 63, 64 82 is arranged along an helix on the support 68, 69, 83 and has a cutting edge with inclination equal to the inclination of the blade support and the contrast roller.

The transversal perforating devices 54 and 56 have possibility to be easily replaced by another first device 54 and another second device 56 with respective blade, for perforating continuous forms 88 (see FIG. 2) to be separated in two longitudinal sections "Sr" and "Sl" along a longitudinal cut "Cl" and on the basis of the codes 60. Moreover, for an easy replacement of the blades, the blade supports of the first device and the second device can mount, in alternative to the blade for perforating the forms 58 to be separated in three longitudinal sections, the blade for perforating the forms 88.

The first perforating device 54 and the third perforating device 57 (FIG. 5) are mounted on a common bridge support 87, with the contrast rollers and blade supports of the device 54 substantially aligned with the contrast rollers and blade supports of the device 57. The two devices 54 and 57 constitute a first modular group 89. The second perforating device 56 is mounted on another bridge support 91 and constitutes a second modular group 92 with the contrast rollers and the blade support shifted with respect to the contrast rollers and the blade supports of the devices 54 and 57 along the direction of feeding of the form.

The bridge supports 87 and 91 are mounted between two sides 93*l* and 93*r* of the sub-frame 77, with possibility of replacing of the modular groups 89 and 92. For the condition of synchronism of the perforation with the feed of the continuous form, the contrast rollers 61, 62 and 79 are actuated by the feeding mechanism of the form. It in a way similar to the one described in the cited patent application TO 2003A000418. In turn, the sub-frame 77 has possibility of transversal regulation for a value "Ad" with respect to the frame 76 so as to exactly position the perforating devices 54, 56 and 57 with respect to the form 58. The regulation, of manual type, is effected through a mechanism with railway and die-screw, not shown in the drawings. This structure results particularly advantageous in view of the fact that, generally, in a system of automatic processing of documents, the printed forms emerge from the printer with a pre-defined fixed alignment.

Specifically, the bridge support 87 includes two sides 94*l* and 94*r*, two crossbars 96*a* and 96*b* and four ribs 97*l*, 97*r* and 98*l*, 98*r* of connection between the crossbars 96*a* and 96*b*. The ribs are also of support in the rotation for the blade supports and the contrast rollers of the perforating device 54 and, respectively, of the perforating device 57. The bridge support 91 includes two sides 99*l* and 99*r*, two crossbars 101*a* and 101*b* and two ribs 102*l* and 102*r* of connection between the crossbars 101*a* and 101*b* and of support, in the rotation, for the blade supports and the contrast rollers of the device 56.

It should be also clear that the perforating devices 54, 56 can be mounted on different independent bridge supports arranged the one behind the other along the direction of movement of the form between the sides 93*l* and 93*r* of the sub-frame 77 and with possibility of independent replacement.

According to another characteristic, the perforating devices 54, 56 and 57 (FIG. 3) comprise respective activation groups, represented with 104, 106 and 107, for rendering operative the contrast member and a circuit control member 108 for the individual driving of the servomechanisms and the activation groups of the three devices. The activation groups operate on the members of contrast for a commutation between a condition of perforation, in which a contrast surface of the contrast member can oppose the indented blade and an inoperative condition of disengagement of the blade.

The activation groups 104, 106 and 107 can be set up in response to a basic program for determining the condition of perforation of a reference blade for the first perforating device and the second perforating device and the inoperative condition of the other blade for perforating the forms 88 (FIG. 2) to be separated into two longitudinal sections and, in alternative, for determining the condition of perforation of the other blade for the first device and the second device and the inoperative condition of the reference blade for perforating the forms 58 to be separated in three longitudinal sections.

The activation groups 104, 106 and 107 (FIG. 3) are particularly useful for "skipping" some perforations on the form in movement. In fact, it has been found that, for reaching high perforation velocities, it can be necessary to maintain the blade in movement at a given velocity immediately after the perforation and execute a free run with "skip" when the distance between the perforations is particularly long. Moreover, the operations of perforation with "skip" result particularly noiseless, and submit the various components of the devices to limited stress.

Figure 13:
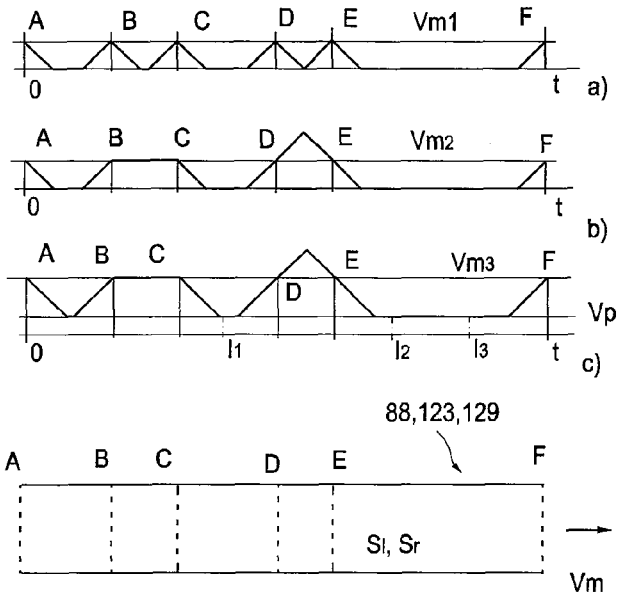
FIG. 13 shows operative diagrams of different perforating devices.

In FIG. 13 are represented, in simplified diagrams Velocity-time a), b) and c), the laws of motion referred to a perforation blade of different perforating devices, and perforations A, B, C, D, E and F to be executed in the continuous form 88.

The diagram a) relates to a device of known type, for instance as described in the cited patent application TO 2003A000418 and in which the reader for the codes is adjacent to the perforating device. The cycle of perforation a) is of a "start-stop" type and provides that the blade is at rest before and after the impact with the form. The blade is accelerated up to the velocity of the form Vm for the perforation in the desired points A, B, C, D, E and F and, thereafter, immediately braked for returning to the condition of rest. For a given maximum acceleration allowed by the servomotor, the minimum distance DE (for instance 7½"), can be obtained with a maximum velocity for the form 88, represented as Vm1 (around 150 m/sec), associated with the minimum arrest time of the blade. However, greater distances as AB, BC, CD and EF, can be obtained by conveniently varying the arrest times of the blade at the external of the impact areas.

In the case of information on the perforation adjacent to the current one, which is available before the execution of the current perforation, for instance by reading in advance the codes of two documents with respect to the perforations of the first document, the execution program can follow the diagram b), with either possibility of arrest of the blade or continuation of the movement. Thus, the minimum distance DE is obtained by accelerating the blade for the first half of the stroke and braking for the second half of the stroke. However, greater distances as AB, CD and EF, are associated to a breaking for an initial stroke of the blade and acceleration for the final stroke and possible arrests, or a combination of accelerations and breaks. The distance BC is obtained without modifying the velocity of the blade. The velocity Vm2 of the form can be greater of the velocity Vm1 obtainable by means of the "start-stop" cycle.

The diagram c) relates to a perforating device according to the invention, with contrast member actuatable by the activation group and in which, as in the case b), the information on the perforation adjacent to current one is available before the execution of the current perforation. The blade is in continuous movement with a basic velocity Vp. Also in this case, after the perforation, the blade is slackened or accelerated for minimizing the period between two adjacent perforations. At equal conditions of power of the device it is possible to obtain the perforations A, B, C, D, E and F at a velocity Vm3 (around 250 m/sec) well greater of the one obtainable by means of the "start-stop" cycle and of the one obtainable with the blade in continuous movement, without "skipping". In particular, the activation group causes the contrast member to be inoperative at the instants I1, I2, I3 in which the blade crosses the area of impact to be not perforated.

The minimum distance DE between adjacent perforations is obtained with acceleration for the first half stroke of the blade and braking for the end stroke. Greater distances as AB, are associated with a breaking for an initial stroke of the blade and acceleration for the final stroke. Distances as CD are obtained with acceleration for the first half stroke of the blade and breaking for the final stroke and driving of the activation group 104, 106 and 107 for causing the contrast member to be inoperative at the instant I1 of the passage of the blade through a not desired area of impact. Distances of perforations well greater, as EF, are obtained by means of a breaking for an initial step of run of the blade, and driving of the activation group for causing the contrast member to be inoperative at the instant I2 of crossing of the blade through a not desired area of impact. It follows a step of acceleration for an intermediate run of the blade with a new driving of the activation group for causing the contrast member to be inoperative at the instant I3 of crossing of the blade through another area of impact and final driving of activation group for causing the perforation F.

Suitably, the perforating devices 54, 56 and 57 are driven by a control member 108 for the servomechanisms 73, 74 and 85 and the activation groups 104, 106 and 107. The control member 108 operates on the servomechanism 73, 74 and 85 for executing a free run of the blade 63, 64 and 82, with minimizing of the time period between two adjacent perforations. Moreover, the control member 108 operates on the activation group 104, 106 and 107 for the inoperative condition of the blade 63, 64 and 82 during the free run and for the condition of interference in association with the perforation in the requested position of the form.

The perforating equipment 53 allows to execute, in a flexible way, perforations in a sheet of paper departing from the data printed and coded in the same sheet and represented by the code 60. In particular, the code 60 feeds information with an application number which addresses to an application chart, which univocally describes the perforations to be executed in the sheet. The applications are programmed in the system by using the followings ways:

1) for default in the software of the perforating equipment;

2) on control of the user through an operative panel; and 3) in response to information of a computer connected with the equipment.

Before the positioning of the page to be perforated on the perforating device, and in due time for executing the operations of perforation, the code sensor reads the marker 59 and the perforation code 60. The perforation data on the code 60 is sent to the program which processes the perforation which, when it will process the corresponding page it associates the respective application to the read code 60 and, therefore, the operations of perforation described by the same application.

Figure 4:
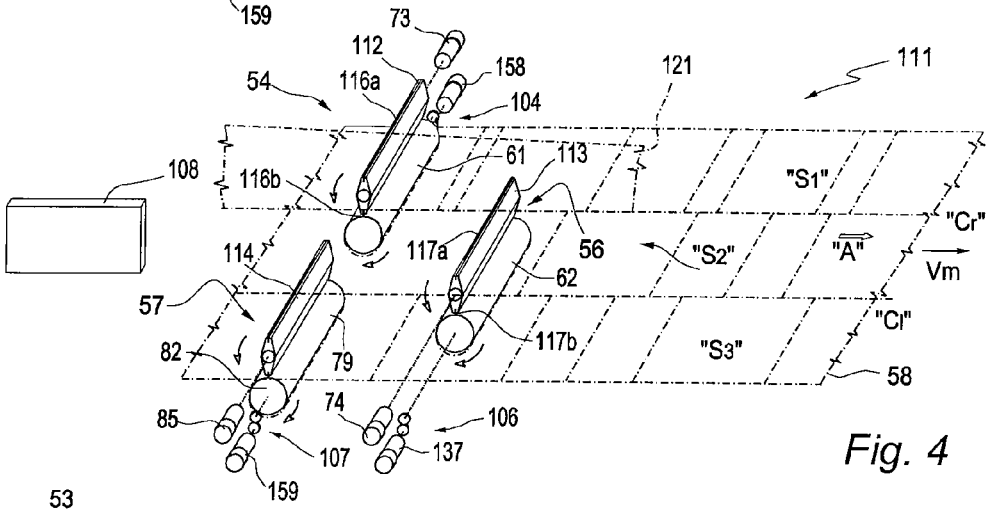
FIG. 4 is a scheme of principle for another example of execution of the perforating equipment according to the invention.

In the embodiment of the FIGS. 3 and 4, the activation groups 104, 106 and 107 are constituted by reciprocal shifting mechanisms between the blade support 68, 69 and 83 and the contrast roller 61, 62 and 83. Each group of activation 106, 107 and 108 is actuatable for modifying the distance between the respective axes of the contrast roller 61, 62 and 79 and the blade support 68, 69 and 83 between a condition of perforation, of engagement of the blades 63, 64 and 82 and an inoperative condition of disengagement of the blades.

Figure 10:
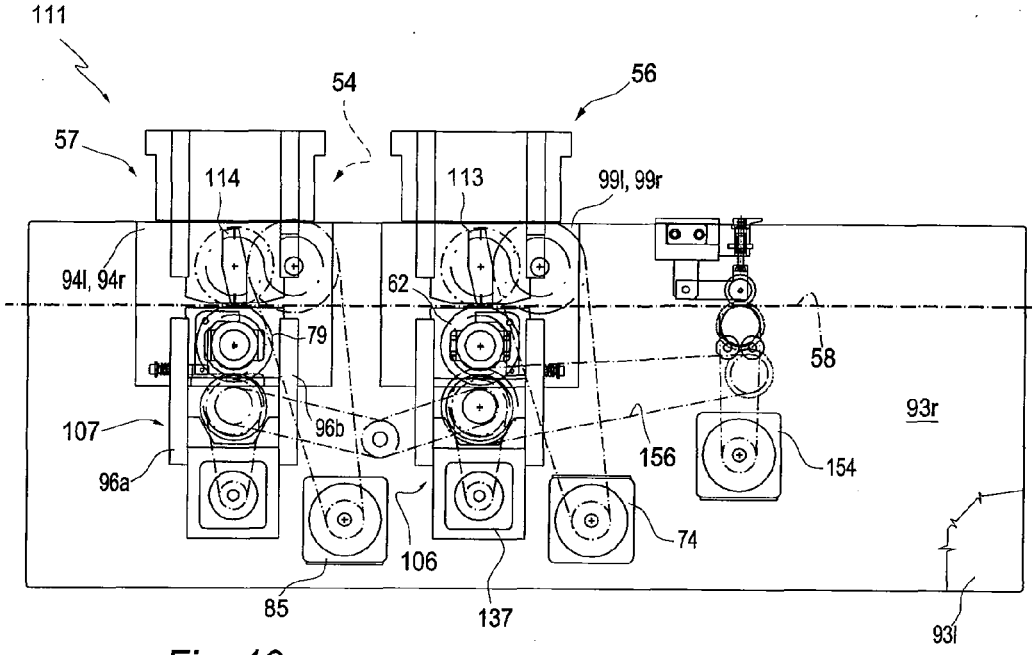
FIG. 10 represents a partial section of a perforating equipment according to the invention.

According to a second embodiment, a perforating equipment 111 (FIGS. 4 and 10) of the invention provides, for the perforating devices 54, 56 and 57, blade supports, herein represented with 112, 113 and 114, having possibility of mounting respective pairs of blades 116*a*, 116*b*; 117*a*, 117*b*; and 118*a*, 118*b*. These blades are functional to the ends which to be obtained:

Greater velocity of perforation on a given typology of the continuous form, with free run of one of the blades, in the case of adjacent perforations; and Fast commutation between asset of perforation for forms to be separated in two longitudinal sections and asset of perforation for forms to be separated in three longitudinal sections.

For the first end, blades of equal length are used, with reduction of the minimum time between adjacent perforations. For the perforation of continuous forms with different characteristics the whole modular groups 89, 92 or the single blades 116*a*, 116*b*; 117*a*, 117*b*; and 118*a*, 118*b* are replaced.

For the second end, the blades 116*a*; 117*a*; and 118*a*, considered as reference blades, have length different with respect to the one of the blades 116*b*; 117*b*; and 118*b*. Thus, for instance, the activation groups 104, 106 and 107 are actuatable for the condition of perforation of the reference blades 116*a*; 117*a*; and 118*a* and the inoperative condition of the blades 116*b*; 117*b*; and 118*b* for the continuous forms to be separated into two longitudinal sections. On the contrary, for the forms to be separated into three longitudinal sections, the activation groups 104, 106 and 107 are actuatable for the condition of perforation of the blades 116*b*; 117*b*; and 118*b* and the condition of disengagement of the reference blades 116*a*; 117*a*; and 118*a*. Also in the case of perforating devices with blades of different length it is possible the fast execution of adjacent perforations through free runs of the blades associated with the specific continuous form.

The blade supports 68, 69 and 83 (FIG. 5) and the contrast rollers 61, 62 and 79 extend through a fraction of the width W of the larger continuous forms 53 and are dimensioned for processing documents with wider transversal dimension. For instance, the length of the blade supports and the contrast member is of 300 mm for processing, in horizontal, documents of A4 ISO standard: The first device 54 perforates the right section "S1" in figure, the second device 56 perforates the central section "S2", while the third device 57 perforates the left section "S3".

For making easier the mutual positioning between continuous forms and blades, the blade support 68 of the first device 54 defines axially an initial limit, common to the blade 63 or the blades 116*a* and 116*b* of FIG. 4 transversely to the direction of feed of the continuous forms. The blade support 69 of the second device 56 axially defines a final limit, common to the blade 64 or the blades 117*a* and 117*b* of FIG. 4. Moreover, the initial limits for the blade 63 or the blades 116*a* and 116*b* and the final limits for the blade 64 or the blades 116*a* and 116*b* lie on a geometric surface 121 perpendicular to the movement surface, along the feeding axis of the continuous form, independently of the typology of the form. The final limits for the blade 82 or the blades 118*a* and 118*b* of FIG. 4 and the initial limits for the blade 64 or the blades 117*a* and 117*b* of FIG. 4 are defined on a geometric surface parallel to the surface 121, but depending on the width of the sections "S1", "S2" and "S3."

By shifting the sub-frame 77, the geometric surface 121 can be positioned along the separation line "Cr" of the form 58 entering in the equipment 53, and defines the transversal positions of the perforations in the sections "S1" and "S2" and "S3". For a form 88 (see FIG. 2), the sub-frame 77 will be shifted for arranging the geometric surface 121 along the separation line "Cc", and defining the perforations of the sections "Sr" and "Sl."

Figure 6:
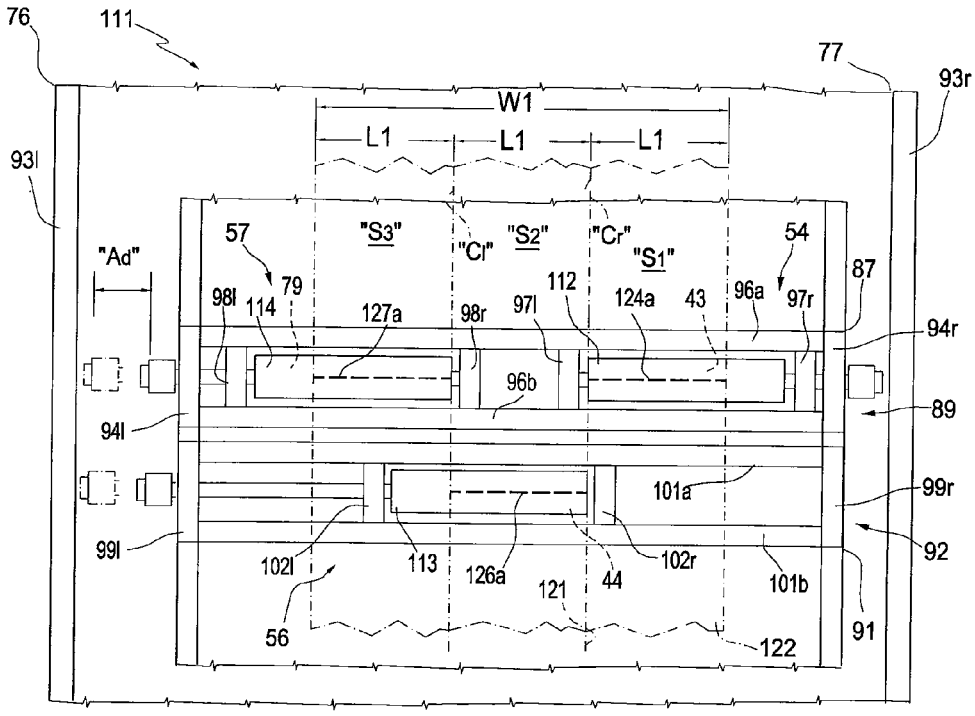
FIG. 6 is a plan view of the components of FIG. 5 in a first operative configuration.
Figure 7:
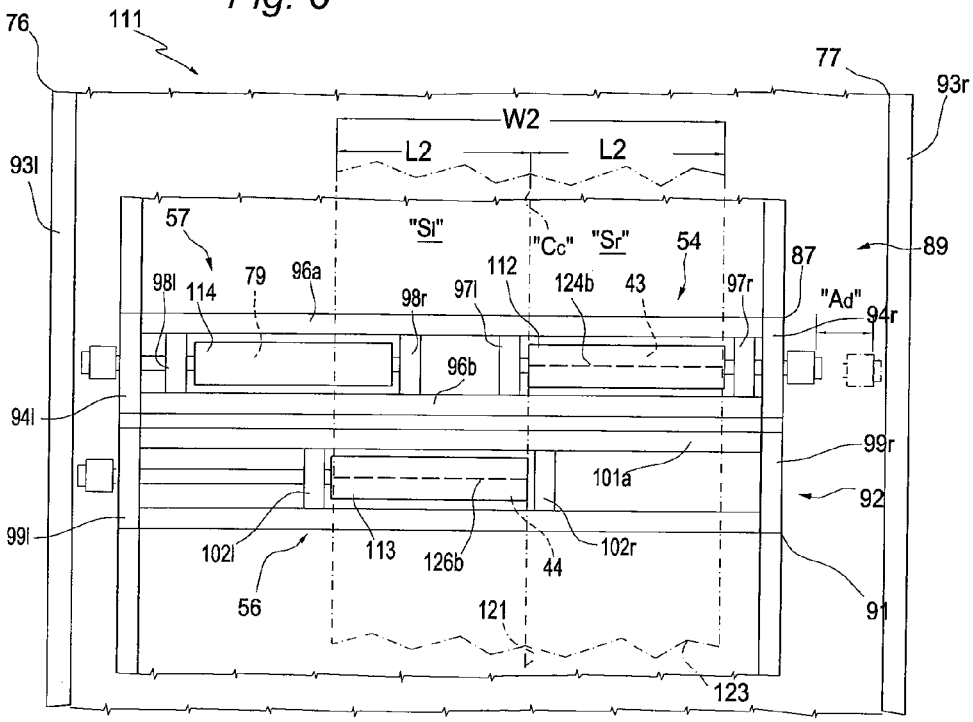
FIG. 7 is a plan view of the components of FIG. 4 in a second operative configuration.

With reference to the FIGS. 6 and 7 the perforating equipment 111 is configured for perforating documents A4, in vertical [portrait] and horizontal [landscape] orientation from continuous forms 122 with minimum width W1 of 630 mm and, respectively, from continuous forms 123 with minimum width W2 of 585 mm. Thus, for the vertical orientation, the reference blades, represented with 124*a*; 126*a*; and 127*a*, have a length L1 of 210 mm. For the horizontal orientation, the blades represented with 124*b* and 126*b* have a length L2 of 297 mm, while no blade is mounted on the blade support 83.

Figure 8:
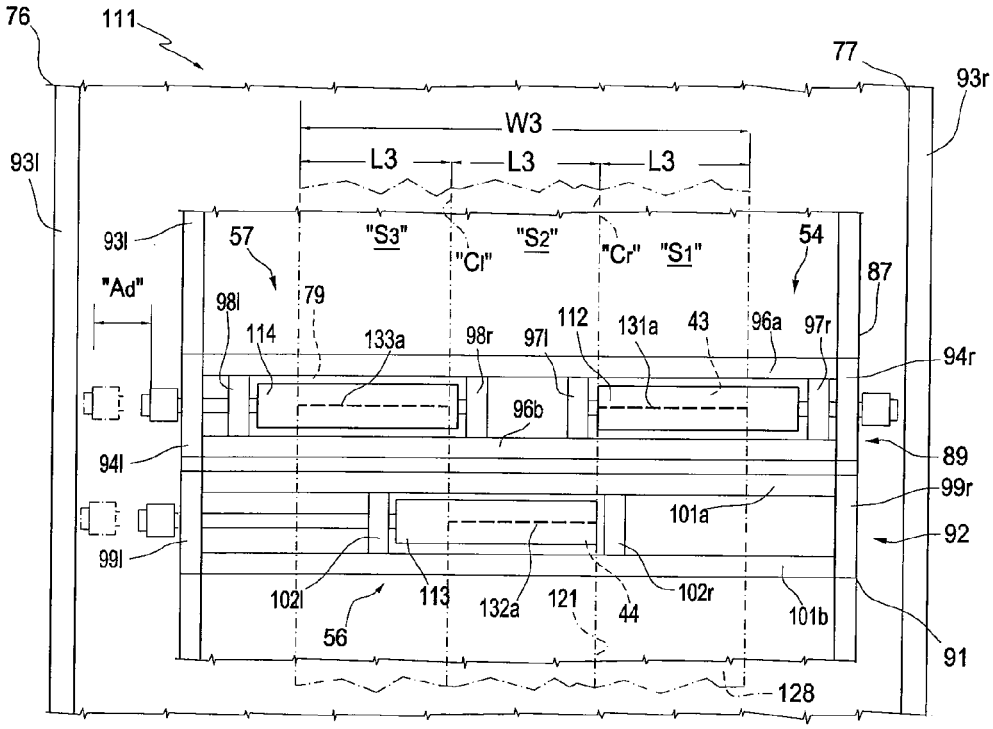
FIG. 8 is a plan view of the components of FIG. 4 in a third operative configuration.
Figure 9:
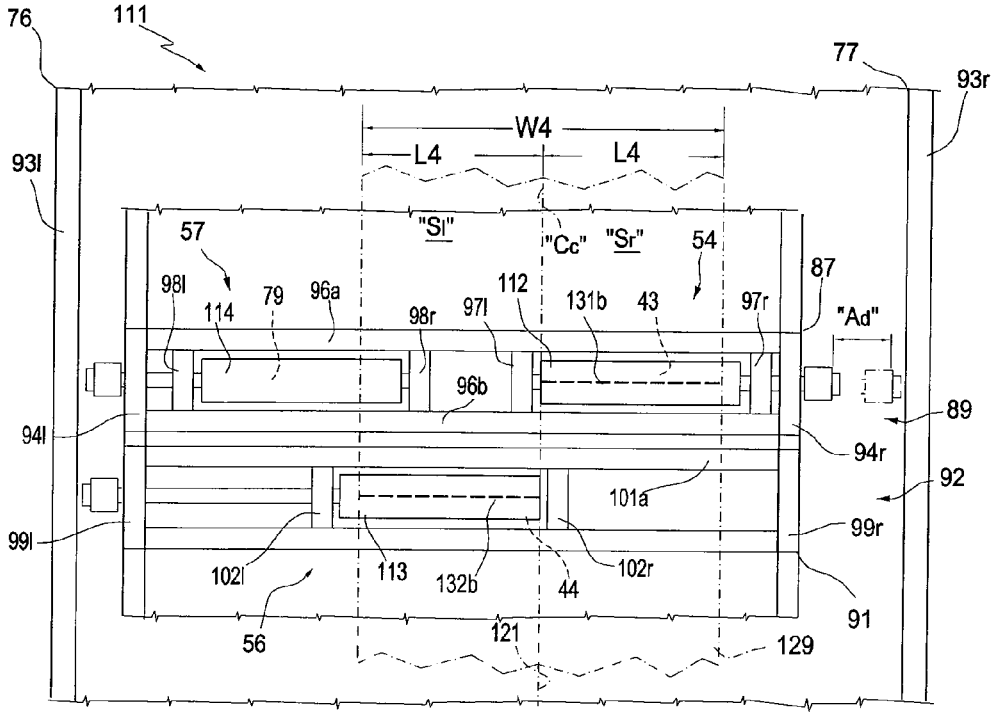
FIG. 9 is a plan view of the components of FIG. 4 in a fourth operative configuration.

In the FIGS. 8 and 9, the perforating equipment 111 is configured for the perforation of continuous forms 128 and documents of vertical orientation, "Legal portrait", with minimum width W3 of 648 mm [25½"], and for the perforation of continuous forms 129 for documents of horizontal orientation, "Legal landscape", with minimum width W4 of 530 mm [22"]. Thus, for the vertical orientation, the reference blades represented with 131*a*; 132*a*; and 133*a* have a length L3 of 216 mm and, for the horizontal orientation, the blades 131*b* and 132*b* have a length L4 of 279 mm, while no blade is mounted on the blade support 83.

Figure 11:
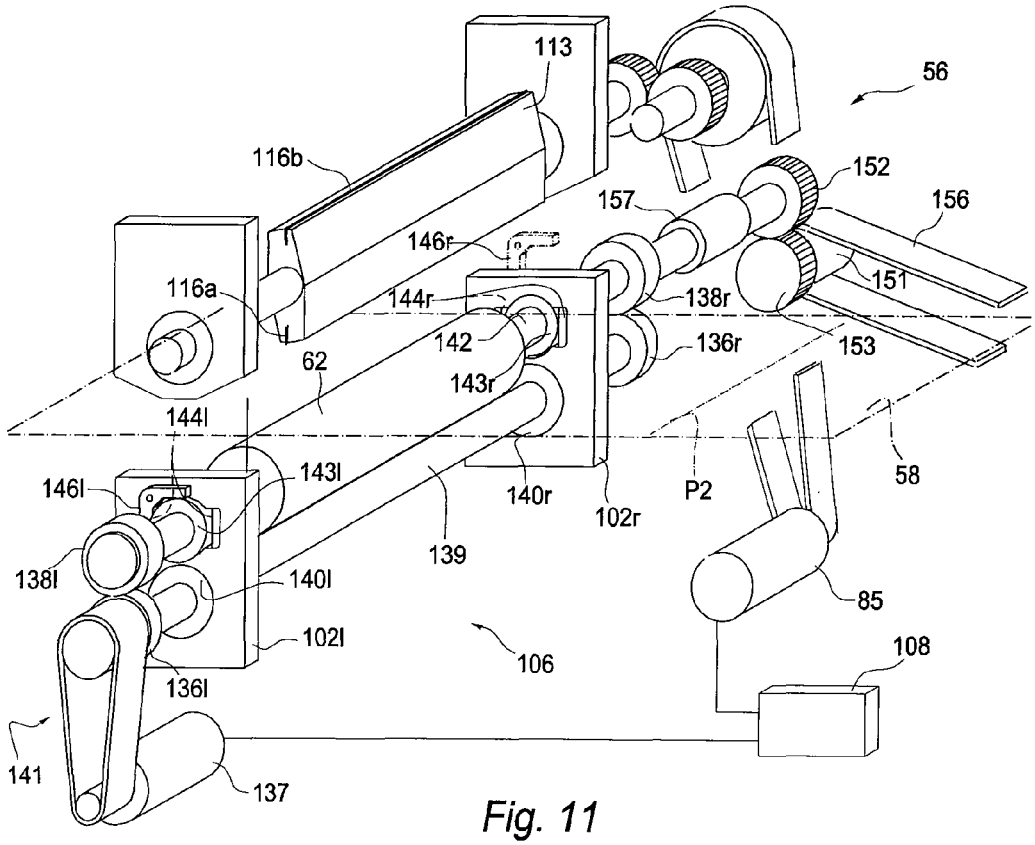
FIG. 11 shows a schematic exploded view of some components of a perforating equipment according to the invention.
Figure 12:
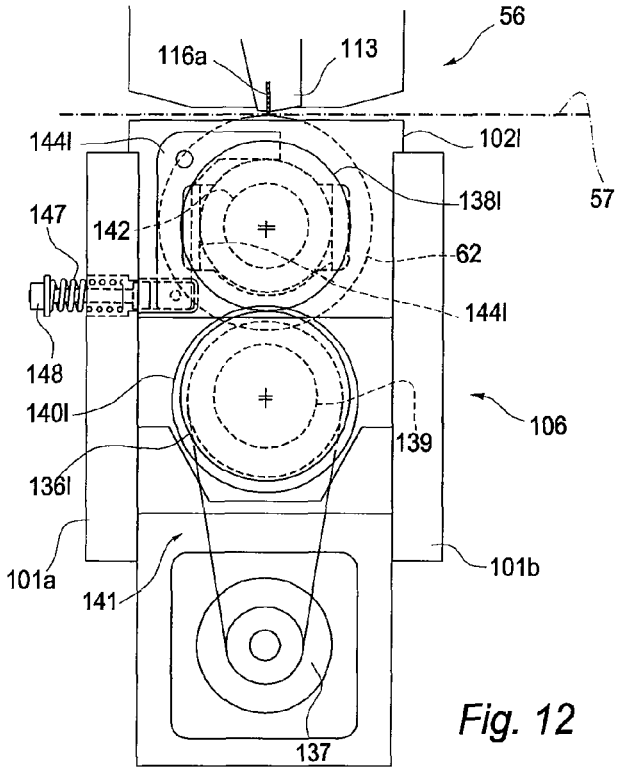
FIG. 12 represents some components of FIG. 10, in enlarged scale.
Figure 14:
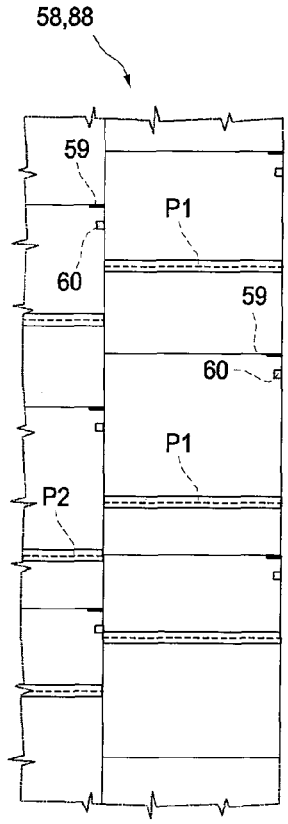
FIG. 14 is a scheme of a continuous form to be perforated.

A reciprocal shifting mechanism, which constitutes, for instance, the actuating group 106 is shown in the FIGS. 11 and 12. The shifting mechanism, also represented with 106, includes two eccentric cams 136*l* and 136*r* actuated by a mutual shifting motor 137 and two cam follower rollers 138*l* and 138*r* connected with the contrast roller 62. In detail, the cams 136*l* and 136*r* are mounted at the sides and underneath the roller 62 and are bodily connected in the rotation by a connecting shaft 139. The shaft 139 is supported by the ribs 102*l* and 102*r* through rolling bearings 140*l* and 140*r* and is connected with the mutual shifting motor 137 by means of a pulley and toothed belt transmission 141. The roller 62 is keyed on a support shaft 142 on which are mounted, adjacent to the roller, two rolling bearings 143*l* and 143*r* and, at the ends, the cam follower rollers 138*l* and 138*r*, also constituted by rolling bearings. The external rings of the bearings 143*l* and 143*r* have possibility of limited slide, in vertical in the use, on pairs of rectilinear guides 144*l* and 144*r* supported by the ribs 102*l* and 102*r*.

The cam follower roller 138*l* and 138*r* cooperate with the cams 136*l* and 136*r* as consequence of the weight of the contrast roller 62 and for the possible action of two levers 146*l* and 146*r* of upside-down "L" shape and springs 147. The levers 146*l* and 146*r* are fulcrumed on the crossbars 102*l* and 102*r* and cooperate, through the upper arm, with the upper portion of the external rings of the bearings 143*l* and 143*r*. The springs 147 are connected with the lower arms of the levers 146*l* and 146*r* and have possibility of regulation through screws 148.

A cycle of actuation of the motor 137 causes a rotation of 360° of the eccentric cams 136*l* and 136 with shifting in vertical of the roller 62 between the operative position, of perforation of the blade, and the inoperative position in which the blade is spaced away from the roller and does not cause any perforation. This shifting is of limited value, of about 0.6 mm.

For the rotation of the contrast roller 62 in synchronism with the movement of the continuous form, the shaft 142 is connected in the rotation with a return pulley 151, through a pair of gears 152 and 153. The pulley 151 and the gear 153 are synchronous in the rotation and are supported, in rotatable way, by a small side of the sub-frame 77. The pulley 151 is connected with a form feeding motor 154, similar to the motor 42, through a toothed belt 156 and other, not numbered, belts and pulleys. Also the gear 152 is supported by the small side of the sub-frame 77 and a cardanic joint 157 between the shaft 142 and the gear 152 ensures the transmission of the motion on the roller 62 during the shifting by the mechanism 106.

The actuating groups 104 and 107 are constituted by reciprocal shifting mechanisms of identical references, having structure similar to the one of the mechanism 106 and, respectively, actuated by reciprocal shifting motors 158 and 159. For the rotation of the contrast rollers 61 and 83, in view of the limited extension of the shifting, the gear 152 is fixed at an end of the shaft 142 and it is moved with the rollers, while the motion is transmitted by the maintenance of the taking between the teeth of the gears 152 and 153.

Figure 15:
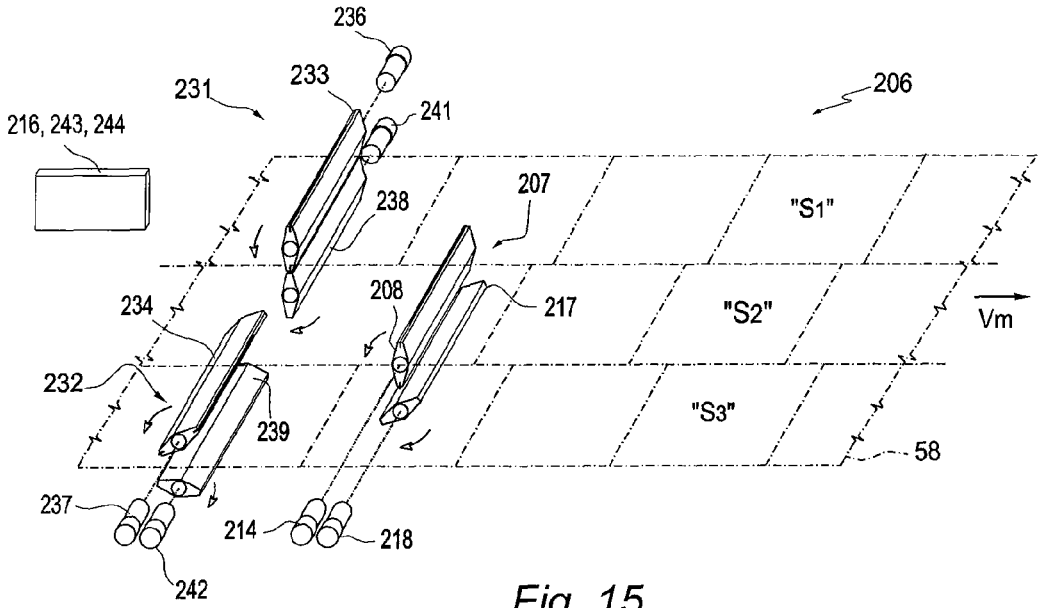
FIG. 15 is a scheme of principle of another embodiment of the perforating equipment according to the invention in a given operative condition.
Figure 16:
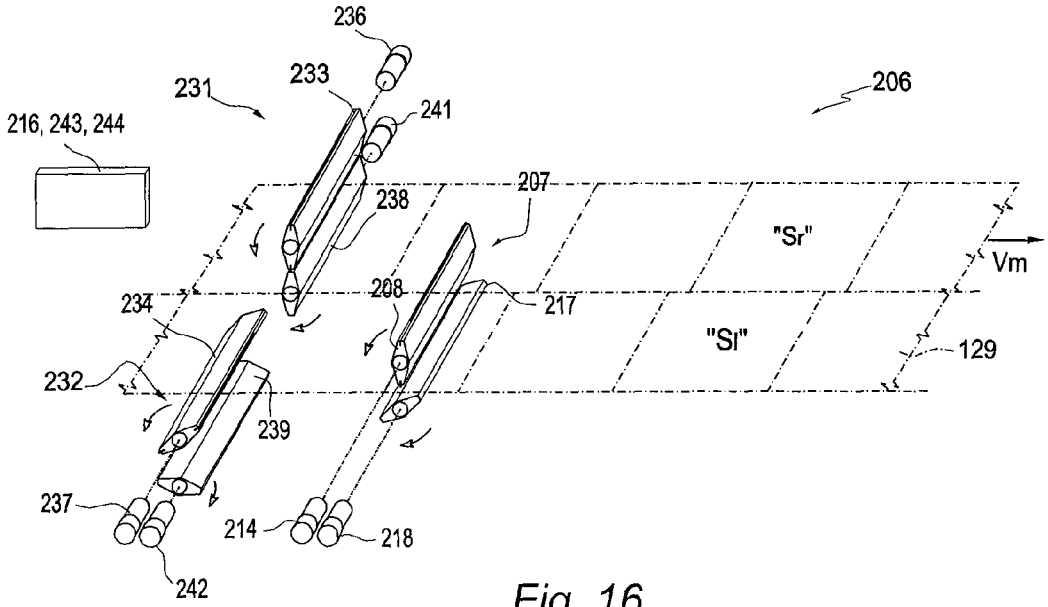
FIG. 16 is the scheme of FIG. 15 in another operative condition.

According to a third embodiment of the invention, a perforating equipment, represented with 206 in FIGS. 15 and 16, also comprises three perforating devices 207, 231 and 232.

Figure 17:
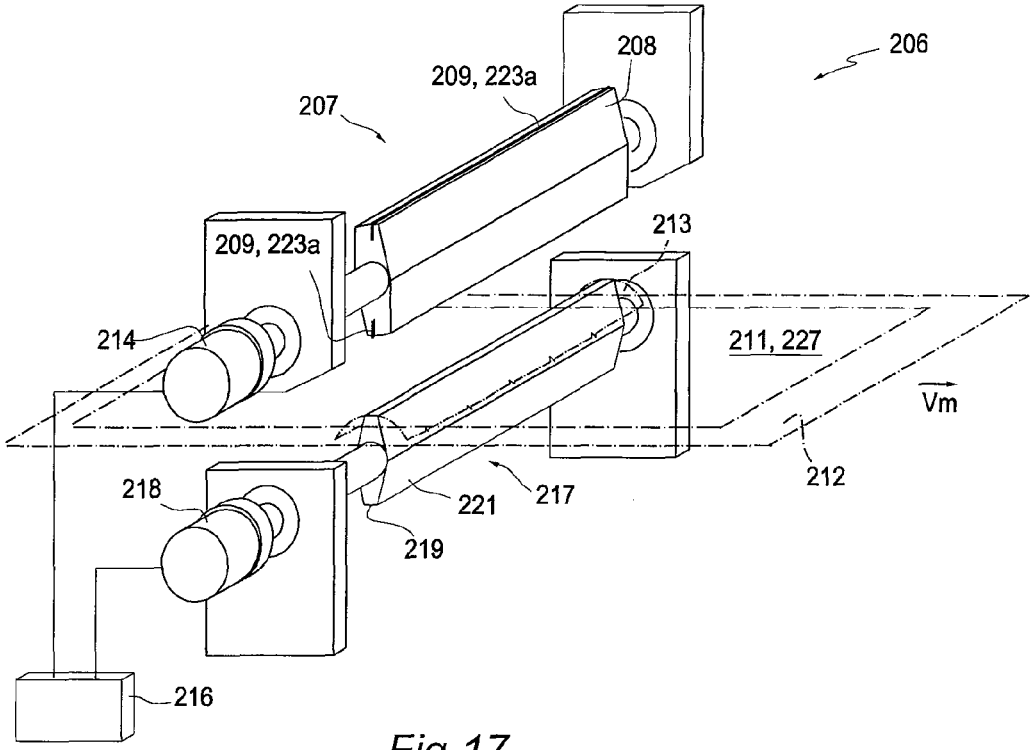
FIG. 17 shows a schematic exploded view of some components of the perforating equipment of FIGS. 15 and 16.

The perforating device 207 is considered in FIG. 17 for perforating a continuous form 211, 227 in movement at the velocity Vm. The device 207 includes a blade support 208 with at least a perforation blade 209, a contrast member 217, an activation group 218 for rendering operative the contrast member 217 and a control circuit member 216. A blade servomechanism 214 is actuatable for rotating the support blade 208 upon an interference condition of the blade at an operative area, for the perforation with the form and perforation in a requested position. It is defined on a contrast surface 213 of cylindrical development, in synchronism with the velocity Vm of the form. The control circuit member 216 drives the blade servomechanism 214 substantially as for the driving of the similar components of the equipment 56 of FIG. 11.

In this third embodiment, the contrast member 217 (FIG. 17) has limited inertia, and is provided for rotating in condition of substantially parallelism with the blade support 208. The contrast member 217 has an active section or more active sections 219 for the perforation, and a remaining inactive section or more remaining inactive sections 221. The activation group 218 is constituted by a contrast servomechanism with identical reference provided for rotating the contrast member 217 between a condition of perforation and a condition of non-perforation of the blade 209 or a selected blade.

The active section or each active sections 219 (FIGS. 19*a*+19*e*) is constituted by a cylindrical sector having the same generatrix of the surface 213, while the inactive section or each inactive section 221 is constituted by surfaces having profiles of reduced radius with respect to the surface 213. The active section or each active section 219 is positionable in a condition of tangency with a movement surface 212 of the continuous form 211, 227 to define the contrast surface 213 for the perforation of the form in the operative area of the blade 209 or a selected blade.

Figure 19A:
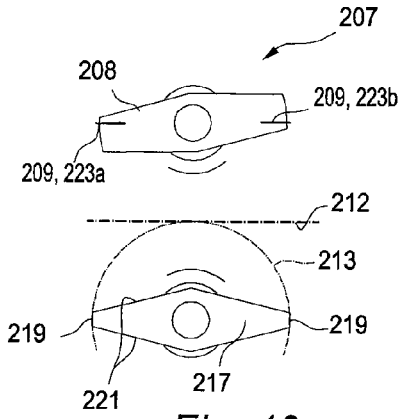
FIGS. 19*a* to 19*e* schematically represent different operative conditions of some components of FIG. 17.
Figure 19B:
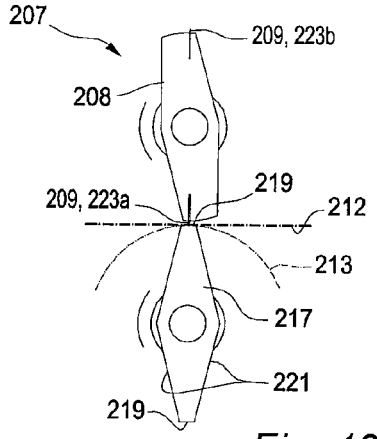
Figure 19C:
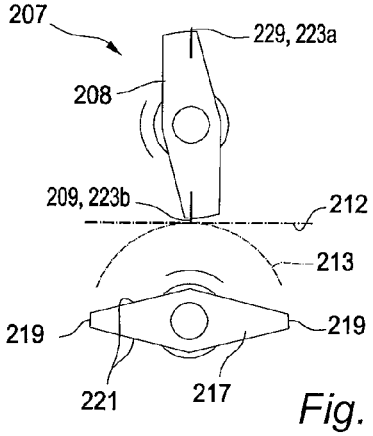
Figure 19D:
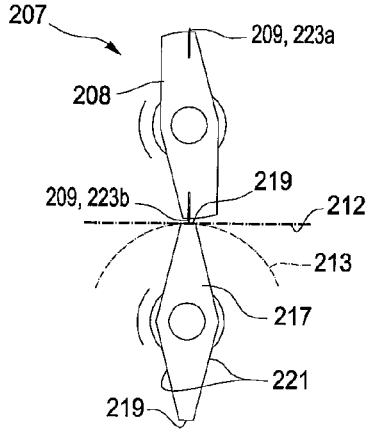
Figure 19E:
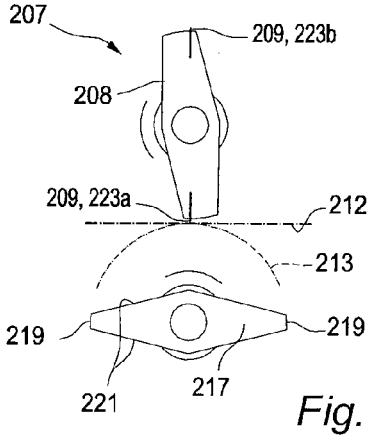

The inactive section or each inactive section 221 is positionable in front of the operative area of the blade 209 or other transiting blade in a condition spaced away from the movement surface 212 (FIGS. 19*c* and 19*e*). For the condition of perforation, the control circuit member 216 operates on the contrast servomechanism 218 for rotating the contrast member 217 with the active section or one of the active sections 219 (FIGS. 19*b* and 19*d*) in the condition of tangency and in synchronism with the velocity Vm of the form 211, 227. For the condition of non-perforation, the control circuit member 216 (FIG. 17) operates on the contrast servomechanism 218 for positioning the contrast member with the inactive section or one of the inactive sections 221 spaced away from the movement surface and, therefore, spaced away from the operative area of the blade 209 or other transiting blade.

The blade servomechanism 214 can maintain the blade 209 or other selected blade in movement after the perforation at a suitable basic velocity and selectively execute an idle run of the blade between two adjacent perforations, as previously described. At the same time, the contrast servomechanism 218 rotates the contrast member 217 with the inactive sections spaced away from the movement surface, in condition of arrest or in movement at a given basic velocity.

Figure 18A:
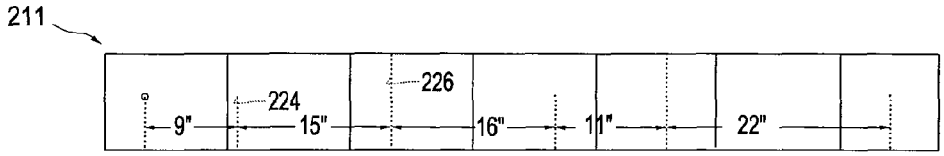
FIGS. 18*a* and 18*b* show schematic examples of continuous forms processed by the equipments of FIGS. 15 and 16.
Figure 18B:
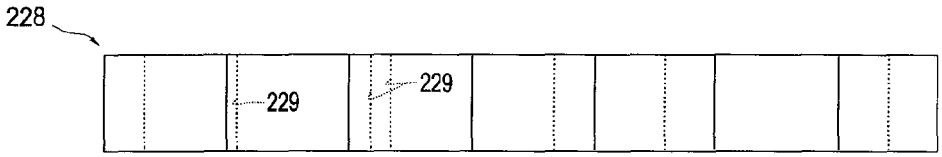

For high speed perforations, exemplary on the form 228 (FIG. 18*b*) two blades 209 or more blades of a same length are mounted on the blade support 208. The mounting of two blades 223*a* and 223*b* or more blades of different lengths allows to selectively execute different typologies of perforations, as perforations 224 and 226 (FIG. 18*a*) of different lengths on the form 211 and having variable positions on the single sheets.

In the operation, as represented in the example of the FIGS. 19*a*+19*e*, the contrast servomechanism can accelerate the contrast member 217 from the condition of FIG. 16*a* to the condition of FIG. 16*b*, in which the active section 219 reachs and maintains the velocity "Vm" and the condition of tangency with the movement surface 212 of the form at the instant "t1". Thus, the section 219 is in front of the blade 223*a* in transit with function of contrast and the first perforation 224 on the form 227 is executed at the instant "t1". Thereafter, the blade servomechanism and the contrast servomechanism proceed with acceleration, brake and following acceleration of the blade support and the contrast member. The phases are such that the contact of the other blade 223*b* with the form occurs at an instant "t2", FIG. 16*c*, while the inactive sector 219 is spaced away from the movement surface and therefore without any action of perforation.

For the perforation of the first longer perforation 224, the blade support and the contrast member are progressively accelerated, braked and arrested. Subsequently, with different laws of motion, the control member 216 drives the blade servomechanism and the contrast servomechanism so as to accelerate the blade support and the contrast member, putting the peripheral velocity of the blade 221*b* and one of the active sections 219 to the velocity Vm and reaching the condition of tangency with the movement surface of the form in an instant "t4", FIG. 16*d*, for the perforation of the section 226 by the blade 221*b*.

The perforating devices 231 and 232 are similar to the device 207 and have, in particular, respective blade supports 233 and 234 driven by servomechanisms blades 236 and 237, contrast members 238 and 239 driven by contrast servomechanisms 241 and 242 and circuit control members 243 and 244. With the devices 207, 231 and 232, the equipment 206 can execute the transversal perforations on the sections "S1", "S2" and "S3" of the form 58 to be separated in three longitudinal sections, as described in connection with the perforating devices 54, 56 and 57 of the equipment 111 shown in FIG. 4.

Also the equipment 206 can process continuous forms 129 (FIG. 16) to be separated into two longitudinal sections through the devices 207 and 231. In this case, the blade supports 208 and 233, respectively, have a blade for executing the transversal perforations "Sr" and "Sl" on the forms 129 to be divided in two longitudinal sections and a blade for executing, in alternative, the transversal perforations on the forms 59 to be divided in three longitudinal sections. The active sections of the contrast members 217 and 238 execute the action of contrast for the perforating blade for the forms to be divided in two longitudinal sections and/or for the perforating blade for the forms to be divided in three sections.

Naturally, the principle of the invention remaining the same, the embodiments and the details of construction can broadly be varied with respect to what has been described and illustrated, by way of non-limitative example, without by this, departing from the ambit of the present invention.

The perforating equipment of the invention can, for instance, be modified for the perforation of continuous forms to be longitudinally cut in four or more transversal sections.

We claim:

1. A perforating equipment for continuous forms in movement comprising a first transversal perforating device and a second transversal perforating device for executing transversal perforations on requested positions of the form, wherein said equipment is provided for perforating continuous forms to be divided in three longitudinal sections and comprises a third transversal perforating device similar to the first perforating device, wherein each transversal perforating device includes a contrast member with a contrast surface having possibility of tangency with the movement surface of the form and in synchronism with the form, a blade support provided for rotation and mounting at least a perforating blade, said blade having possibility of interference with the form in movement for executing transversal perforations;

a blade servomechanism servoized to indications of position of the form and controlling the rotation of the blade support for a condition of interference of the blade or a selected blade in the requested position of the form; and an activation group for positioning the contrast surface against the blade or a selected blade in transit; wherein the blade supports of the first perforating device and the second perforating device each mount two blades of which a blade for two section forms is associated to the perforation of continuous forms to be divided in two longitudinal sections and a blade for three section forms is associated to the perforation of continuous forms to be divided in three longitudinal sections; and wherein a controller having at least two modes, in a first mode the activation group of the first and second perforating devices causes the blades for two section forms to engage a respective contrast surface, and in a second mode the activation group of the first and second perforating devices causes the blades for three section forms to engage a respective contrast surface.

2. Equipment according to claim 1, wherein the first perforating device and the third perforating device are provided for executing the lateral perforations of the form to be divided into three sections, while the second perforating device is provided for executing the central perforations.

3. Equipment according to claim 2, wherein the second perforating device has the axis of the blade support spaced away with respect to the axis of the blade support of the first perforating device with respect to the direction of feed of the form; and wherein the blade support of the first device is such to determine, transversally to the direction of movement of the forms, an initial limit common of the blade for three section forms and the blade for two section forms, while the blade support of the second device is such to define, transversally to the direction of movement of the forms, a final limit common to the blade for three section forms and the blade for two section forms.

4. Equipment according to claim 2, wherein the blades for three section forms are sized for the perforation of forms in three longitudinal sections of standardized "portrait" shape, while the blades for two section forms are sized for the perforation of forms in two longitudinal sections of standardized "landscape" shape.

5. Equipment according to claim 2, wherein the first perforating device and the third perforating device are mounted on a common bridge support, with the axes of the blade supports substantially lined up, while the second perforating device is mounted on another bridge support, with the axis of the blade support spaced away with respect to the axes of the blade supports of the one and the other perforating device along the direction of feed of the form.

6. Equipment according to claim 1, wherein each blade servomechanism is provided for executing a free run of the blade for two section forms or the blade for three section forms associated to the perforation, and wherein the activation group is provided for the inoperative condition of the blade for two section forms and the blade for three section forms during the free run of the blade for two section forms or the blade for three section forms and for the condition of interference in association with the perforation.

7. Equipment according to claim 1, wherein each blade support extends for a fraction of the width of the continuous forms to be perforated and wherein the first perforating device, the second perforating device and the third perforating device are mounted on a sub-frame having possibility of transversal regulation with respect to the direction of movement of the form.

8. Equipment according to claim 1, wherein each contrast member is of limited inertia and includes an active section or more active sections and a remaining inactive section or more remaining inactive sections, while the activation group includes a servomechanism of contrast for rotating the member of contrast between a condition of perforation and a condition of non-perforation; wherein:

the active section or each one active section is positionable in condition of tangency with the movement surface of the form for defining the contrast surface of the blade, while the inactive section or each inactive section is spaced away with respect to the surface of tangency; and wherein the servomechanism of contrast, for the condition of perforation, rotates the member of contrast with the active section or one of the active sections in the condition of tangency and in synchronism with the form while, for the condition of non-perforation, it positions the member of contrast, arrested or in movement, with the inactive section or one of the inactive sections far away from the surface of tangency.

9. Equipment according to claim 1, wherein each contrast member is constituted by a roller whose lateral surface constitutes the contrast surface substantially tangent to the movement surface of the form and synchronous with the feeding of the form, while each activation group includes a shifting mechanisms between the blade support and the contrast roller; and wherein each shifting mechanisms is actuatable for modifying the distance between the axes of the contrast roller and the blade support between a condition of perforation, of engagement of the blades and an inoperative condition of disengagement of the blades.

10. Equipment according to claim 1, wherein the first perforating device and the second perforating device have possibility to be replaced by another first perforating device and another second perforating device with respective blade for perforating forms to be divided in two longitudinal sections, or the blade supports of the first device and the second device can mount, in alternative to the blade for perforating the forms to be divided in three sections, a blade for perforating the forms to be divided in two longitudinal sections.

11. Equipment according to claim 1, wherein a circuit control member responds to information of a following perforation in association with the execution of a current perforation and in due time for the following perforation for maintaining, when necessary, the perforating blade in movement after the current perforation at a given basic velocity, in preparation of the following perforation.

* * * * *